US011258167B1

(12) United States Patent
Graf et al.

(10) Patent No.: US 11,258,167 B1
(45) Date of Patent: Feb. 22, 2022

(54) EMBEDDED ANTENNAS IN AEROSTRUCTURES AND ELECTRICALLY SHORT CONFORMAL ANTENNAS

(71) Applicant: Rockwell Collins, Inc., Cedar Rapids, IA (US)

(72) Inventors: Joseph T. Graf, Center Point, IA (US); James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 17/009,514

(22) Filed: Sep. 1, 2020

(51) Int. Cl.
*H01Q 1/28* (2006.01)
*H01Q 9/04* (2006.01)
*H01Q 1/50* (2006.01)

(52) U.S. Cl.
CPC ..... *H01Q 1/287* (2013.01); *H01Q 1/50* (2013.01); *H01Q 9/0428* (2013.01)

(58) Field of Classification Search
CPC ..... H01Q 1/286; H01Q 1/287; H01Q 1/50; H01Q 9/0428
See application file for complete search history.

(56) References Cited

U.S. PATENT DOCUMENTS

| | | | | |
|---|---|---|---|---|
| 5,825,332 | A | 10/1998 | Camacho et al. | |
| 7,109,942 | B2 | 9/2006 | McCarville et al. | |
| 7,436,369 | B2 | 10/2008 | Apostolos | |
| 7,595,765 | B1 | 9/2009 | Hirsch et al. | |
| 7,737,898 | B2 | 6/2010 | Hanusa et al. | |
| 8,149,177 | B1 | 4/2012 | Callus et al. | |
| 8,791,868 | B2 | 7/2014 | McCarthy et al. | |
| 2003/0090427 | A1* | 5/2003 | Solberg, Jr. | H01Q 7/08 343/787 |
| 2011/0095951 | A1* | 4/2011 | McCarthy | H01Q 13/10 343/705 |
| 2014/0320356 | A1* | 10/2014 | Bishop | H01Q 1/287 343/705 |
| 2016/0294043 | A1* | 10/2016 | Pascual Gil | H01Q 1/287 |
| 2019/0326665 | A1* | 10/2019 | Juergens | H01Q 1/50 |
| 2020/0067191 | A1* | 2/2020 | Rogers | H01P 3/08 |

FOREIGN PATENT DOCUMENTS

| | | | |
|---|---|---|---|
| AU | 2016201866 | B2 | 5/2020 |
| CN | 107994319 | A | 5/2018 |
| DE | 4330736 | A1 | 3/1994 |
| DE | 102016100126 | A1 | 7/2016 |
| EP | 3319172 | A1 | 5/2018 |
| EP | 2978070 | B1 | 11/2019 |
| EP | 3133694 | B1 | 12/2019 |
| GB | 654437 | A | 6/1951 |
| GB | 804666 | A | 11/1958 |
| GB | 821907 | A | 10/1959 |
| JP | 1994152217 | A | 6/1996 |

* cited by examiner

*Primary Examiner* — Hoang V Nguyen
(74) *Attorney, Agent, or Firm* — Suiter Swantz pc llo

(57) ABSTRACT

A mobile platform communication system includes one or more HF antennas disposed in the surface of the mobile platform. The HF antenna may comprise one or more mesh screens. Alternatively, or in addition, the HF antennas may comprise characteristic mode transducers to excite metallic features on the mobile platform skin. The mobile platform skin includes a lightning strike protection layer that is disposed within the mobile platform skin around in internal surface of the antenna such that the antenna does not distend the mobile platform skin and increase drag.

13 Claims, 8 Drawing Sheets

EMBEDDED ANTENNAS IN AEROSTRUCTURES AND ELECTRICALLY SHORT CONFORMAL ANTENNAS

BACKGROUND

In many applications, such as military applications, it is desirable to have multiple redundant options for beyond-line-of-sight communication. Traditionally, such communication is primarily via SATCOM and an alternative, high frequency (HF) near vertical incident skywave (NVIS) system capable of beyond-line-of-site communication via interaction with the ionosphere when SATCOM is unavailable. Traditional long-range surface wave or skywave HF systems utilize extremely high output power amplifiers and expensive and heavy weight High-Q/high power antenna impedance matching couplers. These systems rely on an RF launch angle that is horizontal; i.e., more in parallel with the earth's surface. NVIS solutions rely on configurations that launch the RF signal vertically to maximize the energy towards the ionosphere directly above. In a High-Q impedance matching network, antennas are highly reactive. They have a very high reactive impedance that is addressed via coupler resonance. Existing systems drive the reactance of the antenna down to zero and then boost the real part of the impedance as much as possible. Alternatively, the antenna may be tuned via the length of the antenna element by putting traps or switches to make an antenna dynamically, physically grow and shrink. HF NVIS systems are considered unsuitable for some mobile platforms because of the power needs and size of the antennas; they are large and subject small airframes to excessive drag.

HF is a key communication component for the primary-alternate-contingent-emergency (PACE) strategy for nap-of-the-Earth (NOE) communications where an aircraft will often loose line of sight with other aircraft and the SATCOM satellite constellations.

There is a critical need to eliminate drag and antenna count in limited real estate platforms, such as attack helicopters, and also augment beyond-line-of-sight communication capabilities for contested environments.

SUMMARY

In one aspect, embodiments of the inventive concepts disclosed herein are directed to a mobile platform communication system with one or more HF antennas disposed in the surface of the mobile platform. The HF antenna may comprise one or more mesh screens. Alternatively, or in addition, the HF antennas may comprise characteristic mode transducers to excite metallic features on the mobile platform skin.

In a further aspect, the mobile platform skin includes a lightning strike protection layer that is disposed within the mobile platform skin around in internal surface of the antenna such that the antenna does not distend the mobile platform skin and increase drag.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which.

DETAILED DESCRIPTION

Figure 1:
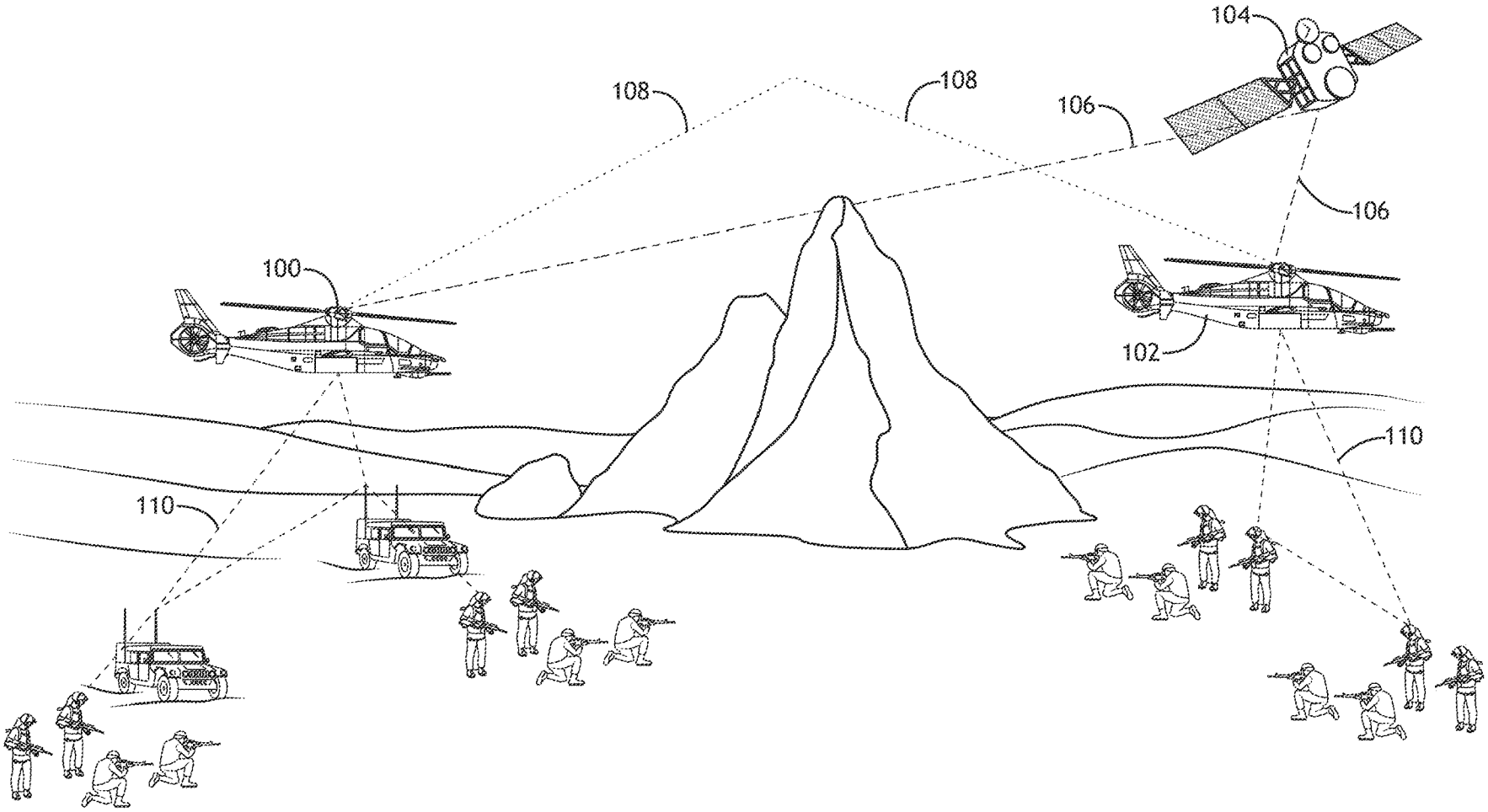
FIG. 1 shows an environmental view of beyond-line-of-sight communication channels.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1a, 1b). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a mobile platform communication system with one or more HF antennas disposed in the surface of the mobile platform. The HF antenna may comprise one or more mesh screens or this, conformal, solid metallic sheets. Alternatively, or in addition, the HF antennas may comprise characteristic mode transducers to excite metallic features on the mobile platform skin.

Referring to FIG. 1, an environmental view of beyond-line-of-sight communication channels is shown. For beyond-line-of-sight communication between two mobile platforms 100, 102, the primary channel is often SATCOM via a satellite 104 that is communicable via signals 106 to and from each mobile platform 100, 102 wherein the satellite 104 relays such signals 106. Communication to and from the satellite 104 may be denied, in which case an alternate channel of communication is necessary. For example, HF signals 108 in an NVIS mode may be sent and received via reflection (or redirection) through the ionosphere; NVIS HF RF signals 106 are directed vertically toward the ionosphere, which in turn scatters RF energy downward. Multiple channels of beyond-line-of-sight communication is especially critical as the mobile platforms 100, 102 may comprise communication nodes between local communication networks 110. NVIS may operate as an HF ad hoc mobile "hot spot." The "hot spot" moves dynamically with the mobile platform 100, 102. Since the propagation channel mode is basically downward, it is immune from line-of-sight blockage of UHF and above radio wave propagation.

NVIS HF signals 108 require antennas of a certain size; for example, an antenna one-half of a wavelength at about 70 MHz would be about seven feet. Such antennas would place a substantial drag on smaller mobile platforms 100, 102 such as helicopters. For example, a traditional "towel bar" antenna configured for such operation would be a key source of drag and would be difficult to place on small platforms.

Figure 2A:
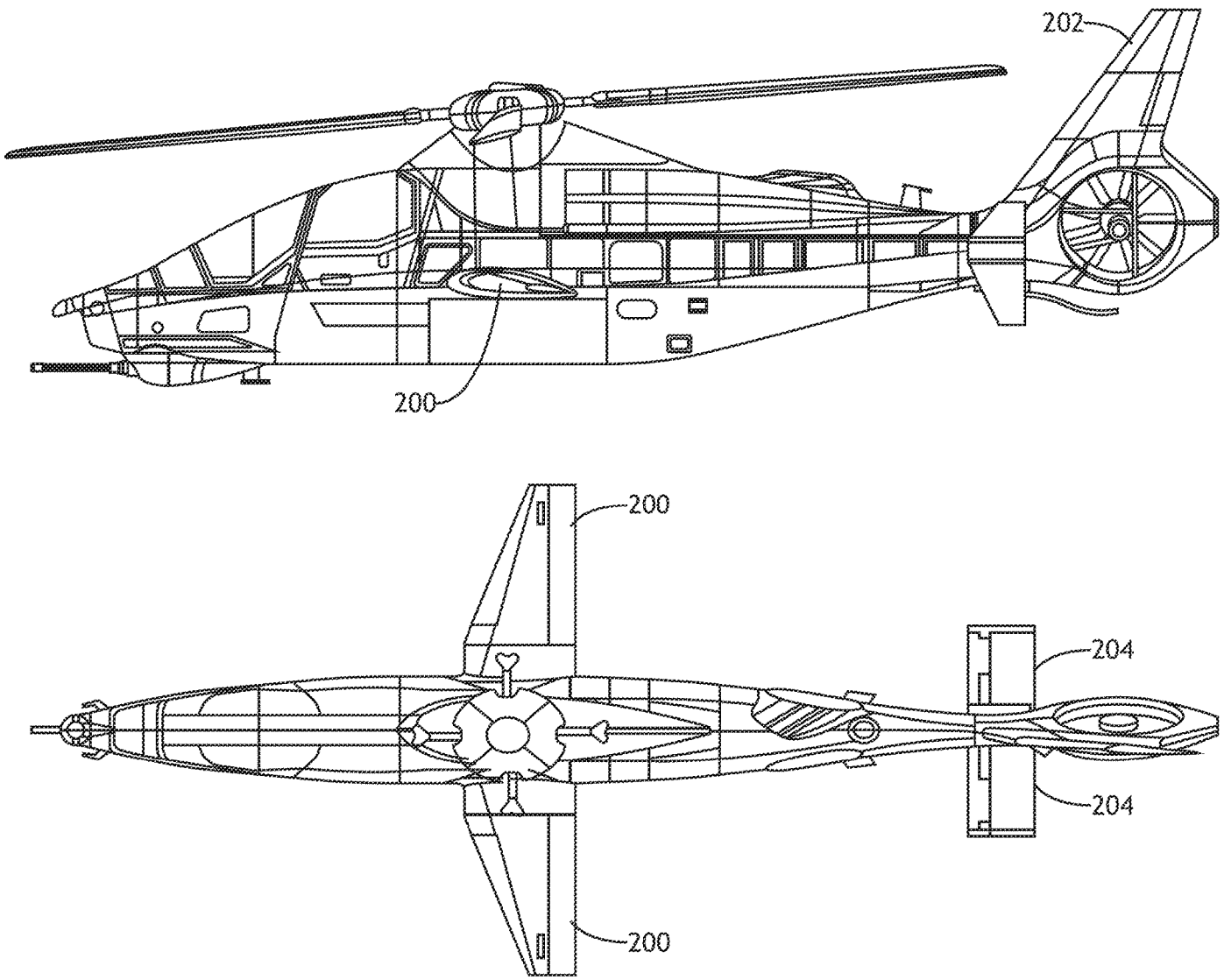
FIG. 2A shows an aircraft including an embedded HF antenna according to an exemplary embodiment.
Figure 2B:
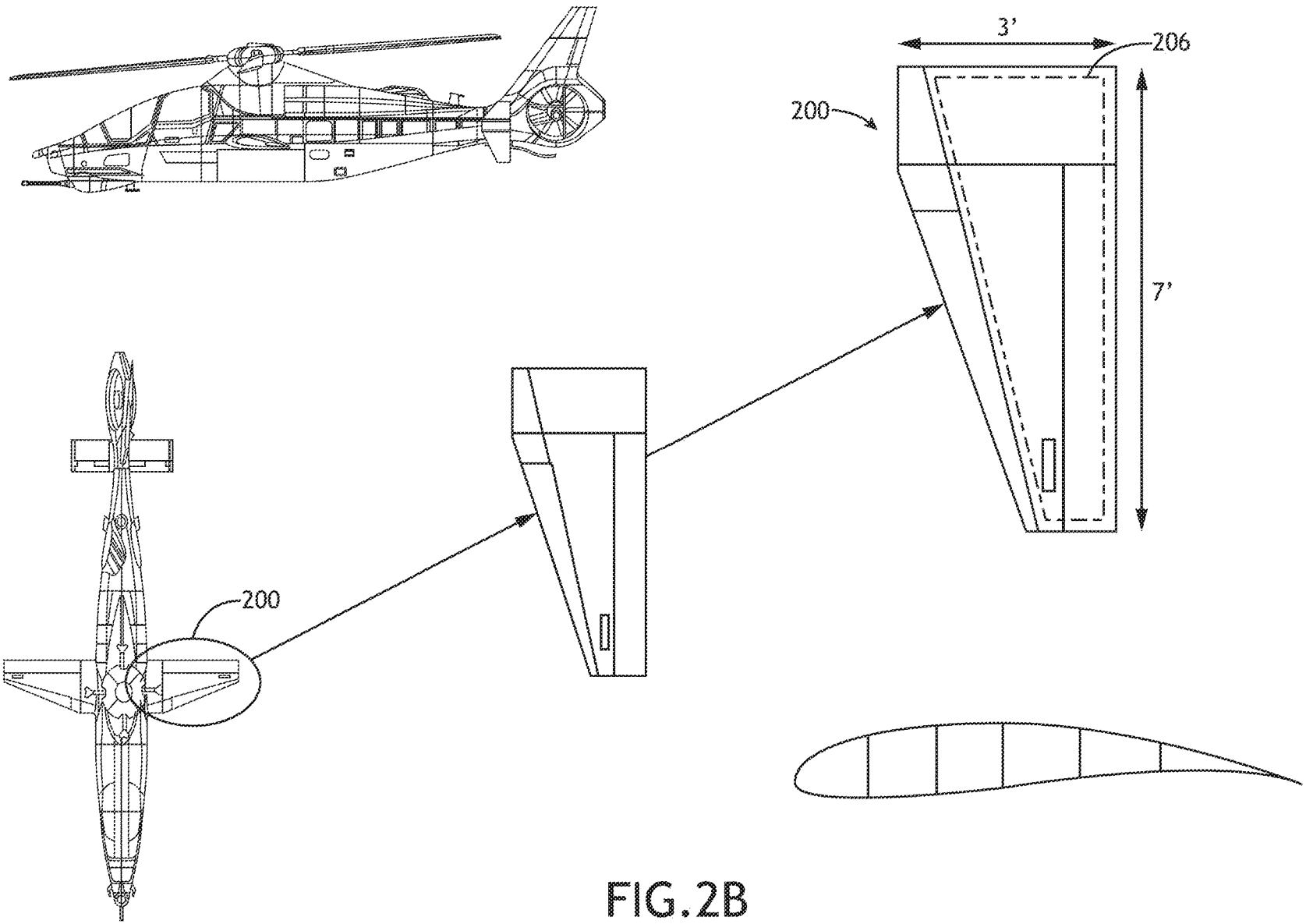
FIG. 2B shows an aircraft including an embedded HF antenna according to an exemplary embodiment.

Referring to FIGS. 2A-2B, an aircraft including an embedded HF antenna according to an exemplary embodiment is shown. Such aircraft includes structural elements 200, 202, 204 suitable for embedded HF antennas 206. In at least one embodiment, a helicopter may comprise two winglets 200 that may include embedded HF antennas 206 that, when operated in tandem, provide an antenna structure of seven feet; sufficient for operating at about 70 MHz. The embedded HF antennas 206 may be incorporated into screen mesh disposed in the composite panels of the aircraft. Such aircraft may include lightning arrestment features; such panels may be structured with the lightning arrestment features disposed beneath the embedded HF antennas 206 as more fully described herein to allow HF signals from the embedded HF antenna 206 to radiate without significant interference from the lighting arrestment features. Furthermore, the HF antenna 206 is disposed without disturbing the lighting arrestment features as more fully described herein. In at least one embodiment, embedded HF antennas 206 may be electrically short. Electrically short antennas are shorter than what is traditionally used for a certain wavelength such as one-half of a wavelength. Embedded HF antennas 206 may be electrically short and still enable a certain level of NVIS communication. HF antennas 206 for NVIS may be integrated in the aircraft helicopter doors, etc. In particular, the HF antennas 206 may be a part of the fuselage itself. One exemplary embodiment may comprise vertically aligned loop antennas, where the axis of the loop is parallel to the horizontal winglets 200.

In one exemplary embodiment, with two-foot winglets 200 operating in tandem, NVIS may be possible using classic antenna for shortened techniques such as line meandering, reactive circuit element loading, etc. Certain levels of NVIS performance is compatible with attack helicopters and ground soldiers. It may be appreciated that while exemplary embodiments describe HF antennas 206 disposed separately in the winglets 200, a singular HF antenna may be disposed across both winglets 200.

In at least one embodiment, embedded HF antennas 206 are disposed in other horizontal surfaces 204 and vertical surfaces 202, including the body of the aircraft. In at least one embodiment, characteristic mode transducers are disposed within panels of the aircraft to exploit resonance of a metallic skin of the aircraft.

In at least one embodiment, active electronic tuning elements may be embedded in composite aircraft assemblies in a modular, connectorized field service repairable architecture for quick troubleshooting without the need to completely replace a set structure with a new assembly.

Radiators suitable for use as embedded HF antennas 206 may include printed UWB radar antenna technologies, fractal, printed UWB bicone/monocone, electrically small loops, UWB slots, combo loop/dipole, meandered Lines, helically loaded dipole/monopole, low-power reactively-tuned structures, reconfigurable metallic patches, characteristic modes, planar/curved reflector back dipoles, 3-D faceted mesh panel horns, etc. Embodiments may utilize tunable reactive loaded antenna shrinking concepts and switchable metallic patch reconfiguration for impedance tuning across the NVIS band.

In at least one embodiment, the embedded HF antennas 206 are configured for transmission and reception of polarized beams. Such polarization may be dual linear polarization (vertical & horizontal linear polarization) or circularly polarization. Structurally integrated antenna sections may enable complex polarization states.

Figure 3:
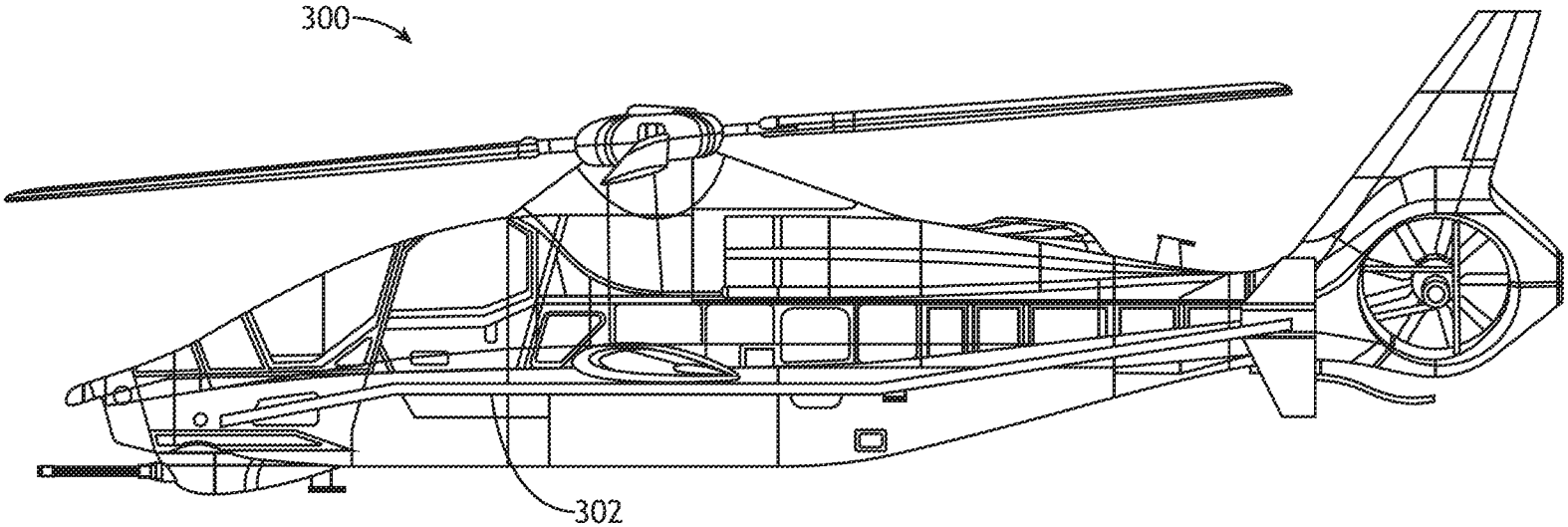
FIG. 3 shows an aircraft including an embedded HF antenna according to an exemplary embodiment.

Referring to FIG. 3, an aircraft 300 including an embedded HF antenna 302 according to an exemplary embodiment is shown. Panels of the aircraft 300 or newly fabricated to include the embedded HF antennas 302; in at least one embodiment, the antennas are comprised of wire mesh in the composite panels of the aircraft 300. Alternatively, or in addition, panels of the aircraft 300 may include characteristic mode transducers for exciting the metallic skin of a panel. Mesh screens electromagnetically behave like solid metal for frequencies that are less than or equal to 1/12 wavelength. Screen mesh density, metal conductivity, mesh strand diameter relative to skin depth and dielectric losses set the upper limits of mesh-based structurally integrated antennas. In at least one embodiment, loops can be integrated in the right, left, or belly sections of the aircraft.

In at least one embodiment, embedded HF antennas 302 in different panels may be integrated to a single continuous antenna, or operate as a single antenna via their contiguous nature.

Figure 4:
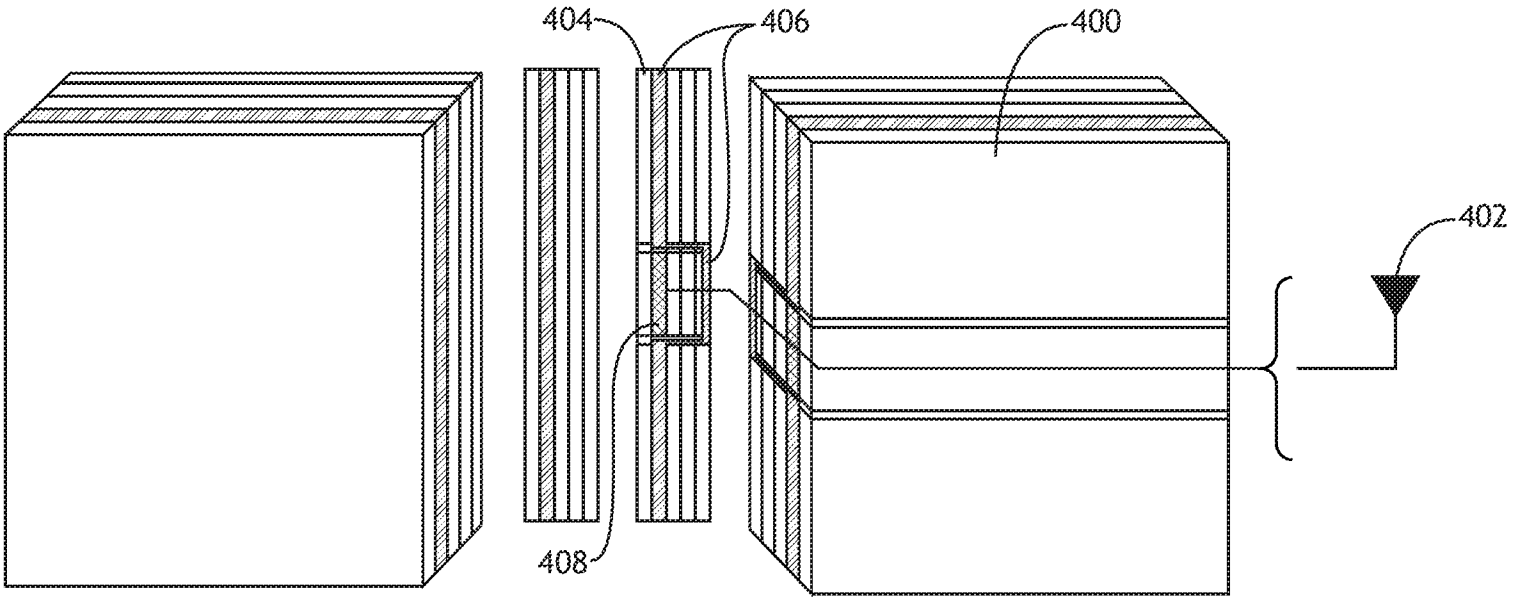
FIG. 4 shows a detail, cross-sectional view of a panel with an embedded HF antenna according to an exemplary embodiment.

Referring to FIG. 4, a detail, cross-sectional view of a panel 400 with an embedded HF antenna 402 according to an exemplary embodiment is shown. Panels 400 for a mobile platform such as an aircraft may comprise a composite of a plurality of layers 404, 406, 408. A top, insulating layer 404 overlays a lightning strike protection layer 406. The lightning strike protection layer 406 may interfere with signals to and from an antenna layer 406; therefore, where there is a separate antenna layer 406, the lightning strike protection layer 406, while still continuous, may recess beneath the antenna layer 406. The antenna layer 406 and an overlaying insulating layer 404 are thereby disposed flush with the surrounding insulating layer 404, and the embedded HF antenna 402 does not add additional drag to the aircraft in spite of the large overall size of the embedded HF antenna 402.

In at least one embodiment, the lightning strike protection layer 406 may comprise a portion of the embedded HF antenna 402.

Figure 5:
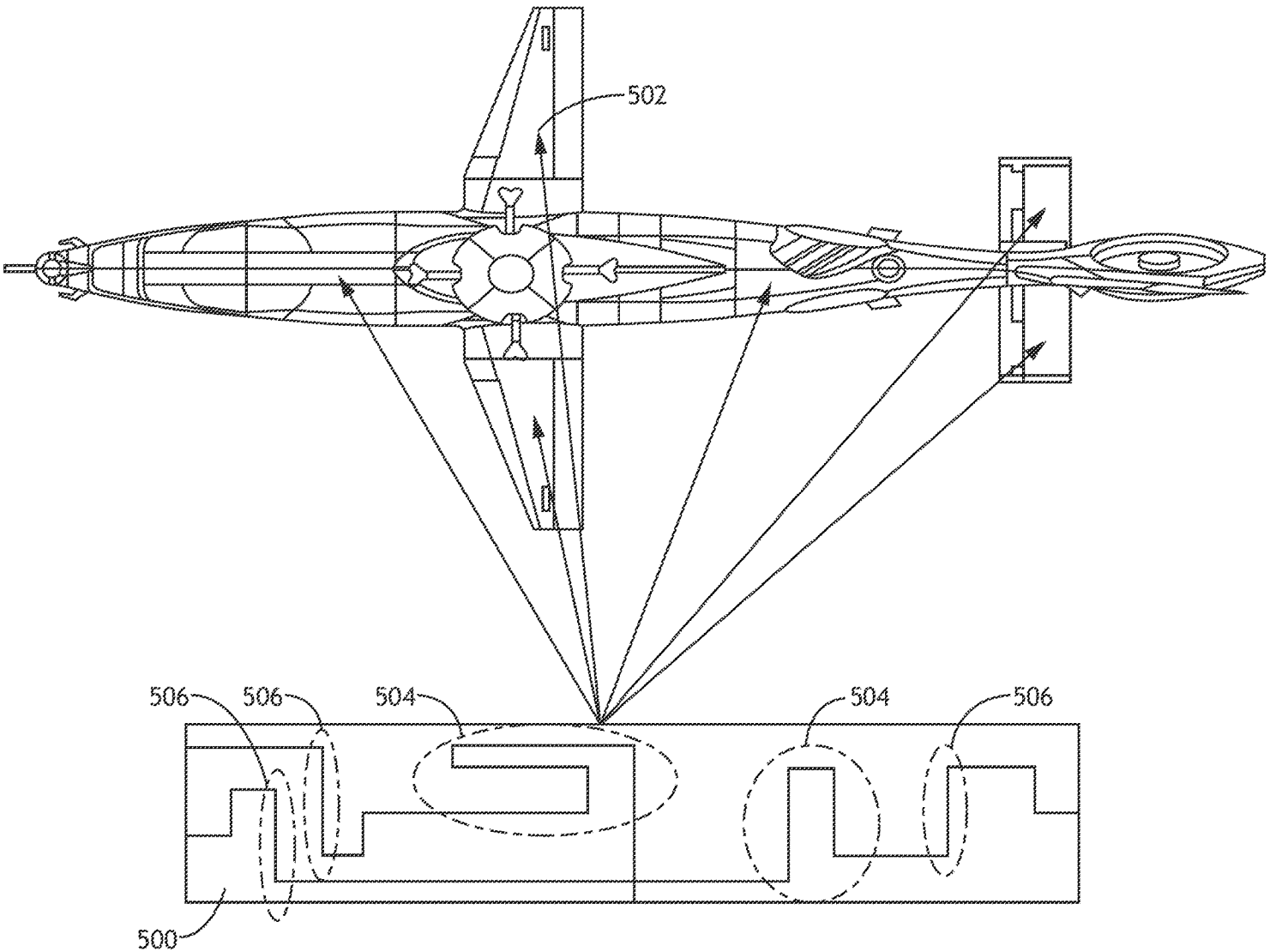
FIG. 5 shows a transducer useful for implementing an embedded HF antenna according to an exemplary embodiment.
Figure 6:
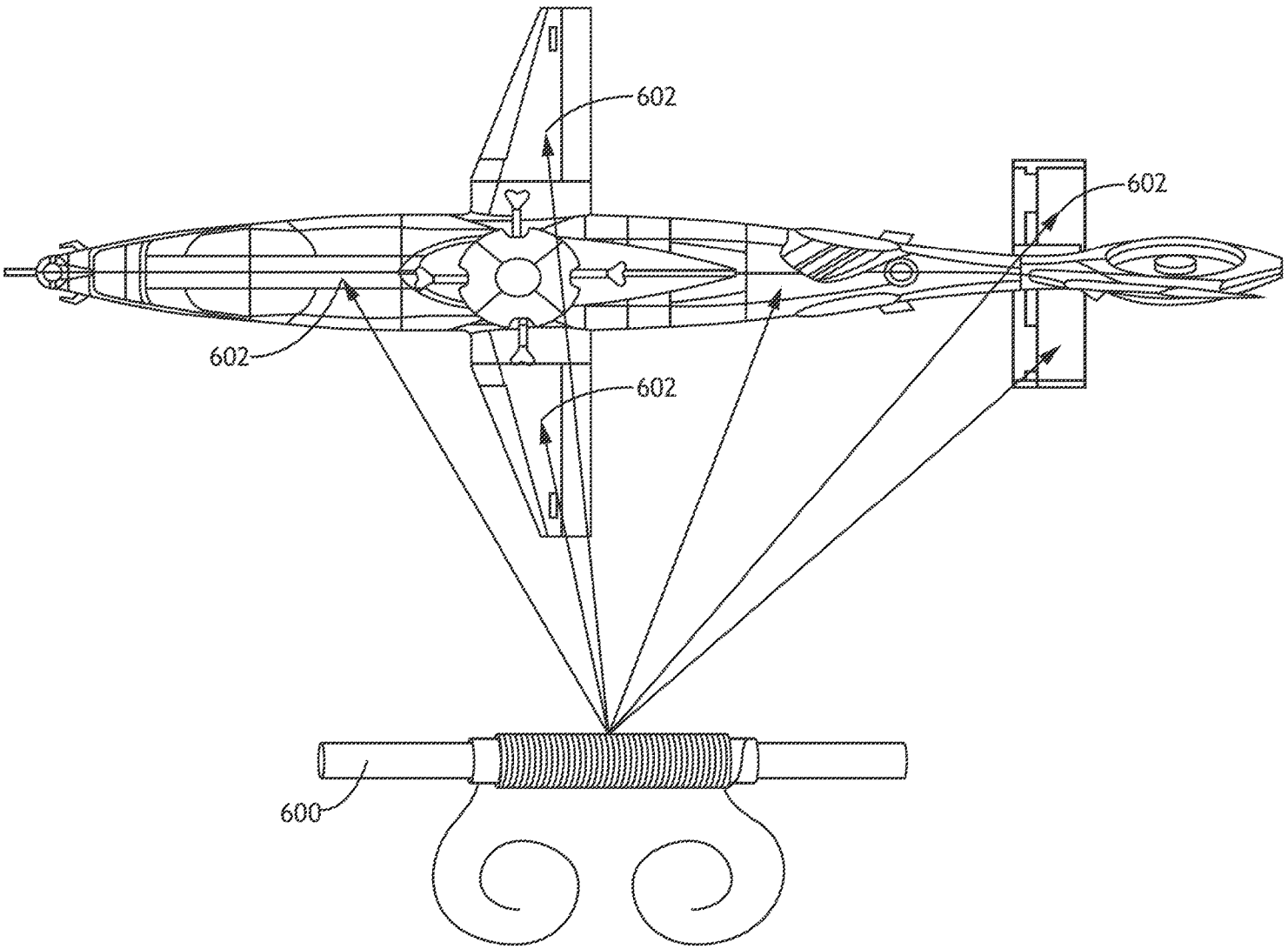
FIG. 6 shows a transducer useful for implementing an embedded HF antenna according to an exemplary embodiment.
Figure 7:
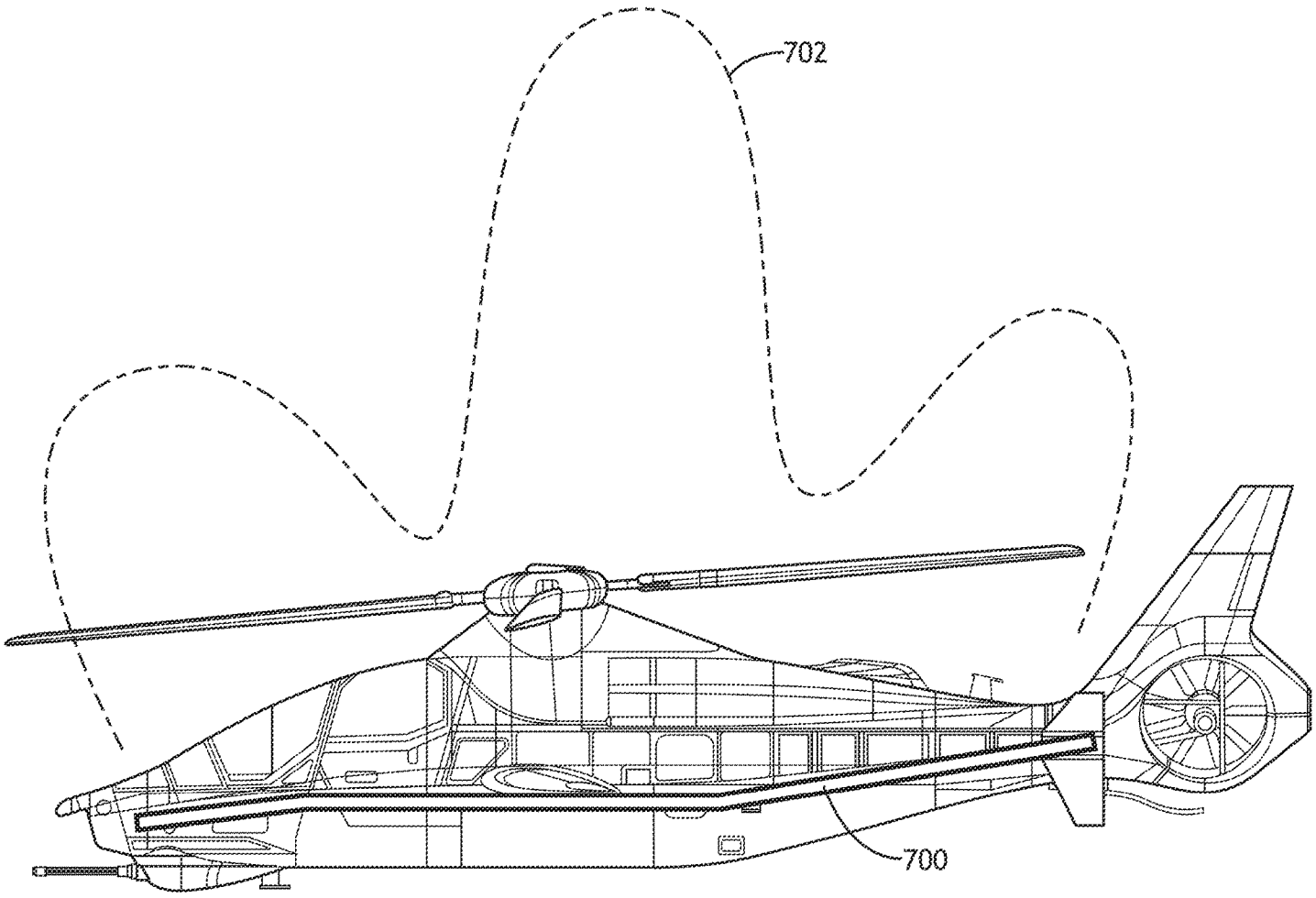
FIG. 7 shows a radiation pattern diagram according to an exemplary embodiment.

Referring to FIGS. 5-7, transducers useful for implementing an embedded HF antenna, and a radiation pattern according to an exemplary embodiment are shown. In at least one embodiment (such as in FIG. 5), characteristic mode transducers 500 may comprise appliques disposed at various locations on or within the metallic skin 502 of a mobile platform, either structurally integrated or affixed to the metallic skin 502 (or composite skin depending on the platform). The transducers 500 may comprise features 504, 506 to adjust the phase and amplitude of applied signals according to the location of the transducer 500 on the metallic skin 502, and similar features of other transducers 500 on the metallic skin 502. Such features 504, 506 may include phase delay lines 504 and impedance transformers 506.

In at least one embodiment the features 504, 506 are configured to exploit Eigen mode resonance on the metallic skin 502 of the mobile platform. The transducers 500 excite complex currents on the metallic skin 502 to synthesize a desired radiation pattern. In at least one embodiment, the transducers 500 and transducer features 504, 506 are configured and disposed for HF NVIS operation.

In at least one embodiment (such as in FIG. 6), ferrite loaded antennas 600 are disposed at various locations 602 on or within the metallic skin of a mobile platform. Loaded ferrite antennas 600 may be arrayed for improved radiation efficiency.

Referring to FIG. 7, an electrically short embedded HF antenna 700 may operate in a common mode/Eigen mode with a radiation pattern 702 suitable for NVIS communication. In at least one embodiment, electrically short antennas may include embedded switches to switch reactive elements in the metallic structure of the aircraft. For example, a wing section could have a switching element embedded in it as opposed to having it in a coupler.

In at least one embodiment, embedded antennas may comprise a metamaterial configured for the operative frequency of the antenna.

Embodiments may be useful for lower-band communications (HF, VHF, UHF—up to 1 GHz), and may comprise a vital component of a PACE (Primary Alternate Contingency Emergency) communication plan. These concepts can easily scale from HF up to above L-band, providing the possibility for tactical communications with no impact on drag. The concepts herein are extendable to microwave frequencies.

Embedded antennas according to exemplary embodiments preclude the need for antenna couplers and high output power amplifiers. Antenna shapes/structures are made to be compatible with structural/environmental and material constraints. Lightning arrestment is maintained by choking/surface currents trapping. Embedded HF antennas can be 3-D in nature to reduce antenna Q by maximizing antenna volume.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages; and individual features from various embodiments may be combined to arrive at other embodiments. The form herein before described being merely an explanatory embodiment thereof, it is the intention of the following claims to encompass and include such changes. Furthermore, any of the features disclosed in relation to any of the individual embodiments may be incorporated into any other embodiment.

What is claimed is:

1. A mobile platform comprising:

one or more high-frequency antenna panels disposed in a body panel of the mobile platform; and a lightning arresting layer disposed in the body panel configured to allow the one or more high-frequency panels to radiate while maintaining a lightning protection system's integrity, wherein:

the one or more high-frequency antenna panels are disposed to be flush with an exterior surface of the body panel;

the one or more high-frequency antenna panels are configured and disposed for high-frequency near vertical incident skywave communication; and the lightning arresting layer is configured to transit from a first depth proximal to the exterior surface to a second, lower depth beneath the one or more high-frequency antenna panels.

2. The mobile platform of claim 1, wherein at least one of the one or more high-frequency antenna panels are configured for circular polarization.

3. The mobile platform of claim 1, wherein each of the at least of the one or more high-frequency antenna panels is configured to operate in tandem with at least one other of the at least one of the one or more high-frequency antenna panels.

4. The mobile platform of claim 1, wherein the one or more high-frequency antenna panels are disposed in lateral body panels of the mobile platform.

5. The mobile platform of claim 1, wherein the one or more high-frequency antenna panels are configured for dual linear polarization.

6. The mobile platform of claim 1, wherein the one or more high-frequency antenna panels are individually electrically small with respect to an operating frequency.

7. The mobile platform of claim 6, wherein each of the one or more high-frequency antenna panels comprises a ferrite loaded antenna.

8. A communication system comprising:

a plurality of common mode transducers disposed various locations of a mobile platform; and a lightning arresting layer disposed on one or more body panels configured to allow the common mode transducers to radiate while maintaining a lightning protection system's integrity, wherein the plurality of common mode transducers are configured to:

communicate beyond line-of-site via high-frequency near vertical incident skywave; and induce an Eigen mode resonance in a metallic skin of the mobile platform; and wherein the lightning arresting layer is configured to transit from a first depth proximal to an exterior surface of the one or more body panels to a second, lower depth beneath the common mode transducers.

9. The communication system of claim 8, wherein at least one of the plurality of common mode transducers is disposed in a superior surface of each of a set of winglets of the mobile platform.

10. The communication system of claim 9, wherein each of the at least of the plurality of common mode transducers is configured to operate in tandem with the other of the at least one of one or more high-frequency antennas.

11. The communication system of claim 8, wherein the plurality of common mode transducers are disposed in lateral body panels of the mobile platform.

12. The communication system of claim 8, wherein the plurality of common mode transducers are individually electrically small with respect to an operating frequency.

13. The communication system of claim 8, wherein each of the plurality of common mode transducers comprises a printer circuit board having one or more phase delay features and one or more impedance features.

* * * * *